US007585185B2

(12) United States Patent
Obikane

(10) Patent No.: US 7,585,185 B2
(45) Date of Patent: Sep. 8, 2009

(54) CONNECTOR

(75) Inventor: Hiroaki Obikane, Tokyo (JP)

(73) Assignee: Japan Aviation Electronics Industry Limited, Tokyo (JP)

( * ) Notice: Subject to any disclaimer, the term of this patent is extended or adjusted under 35 U.S.C. 154(b) by 0 days.

(21) Appl. No.: 12/072,705

(22) Filed: Feb. 27, 2008

(65) Prior Publication Data

US 2008/0214051 A1 Sep. 4, 2008

(30) Foreign Application Priority Data

Mar. 1, 2007 (JP) ..... 2007-051561

(51) Int. Cl.
*H01R 13/648* (2006.01)

(52) U.S. Cl. ..... 439/607; 439/74; 439/108

(58) Field of Classification Search ..... 439/660, 439/74, 607, 609
See application file for complete search history.

(56) References Cited

U.S. PATENT DOCUMENTS 6,019,616 A * 2/2000 Yagi et al. ..... 439/108
6,250,935 B1 * 6/2001 Mochizuki et al. ..... 439/74
6,394,841 B1 * 5/2002 Matsuura ..... 439/607
6,503,101 B1 * 1/2003 Yu ..... 439/607
7,052,320 B2 * 5/2006 Zhang et al. ..... 439/607
7,134,912 B2 * 11/2006 Kamata et al. ..... 439/609

FOREIGN PATENT DOCUMENTS

JP 11-233201 A 8/1999

* cited by examiner

*Primary Examiner*—Truc T Nguyen
*Assistant Examiner*—Xuong M Chung-Trans
(74) *Attorney, Agent, or Firm*—Frishauf, Holtz, Goodman & Chick, P.C.

(57) ABSTRACT

A connector capable of sufficiently shielding two connectors for connecting two circuit boards, and further making the connectors compact in size. A receptacle-side fitting portion (32) for being fitted to a plug-side fitting portion (142) of a plug connector (12) is formed in a receptacle-side housing (3) disposed on a printed circuit board (21). A plurality of receptacle-side contacts (5) are arranged in the receptacle-side fitting portion (32). A shell body (71) disposed around the receptacle-side fitting portion (32) is provided in a shell (7) mounted in receptacle-side housing (3). The shell (7) is formed with shell contact portions (72) brought into contact with plug-side ground contacts (16G) of the plug connector (12), and a shell terminal portion (73) fixed to a ground pad (21) of the printed circuit board (21).

2 Claims, 15 Drawing Sheets

1
3
7
74
75
A
B
C
D
5(5S)
5(5G)

CONNECTOR

BACKGROUND OF THE INVENTION

1. Field of the Invention

This invention relates to a connector device for connecting two circuit boards, and more particularly to a connector device having shielding means.

2. Description of the Related Art

Conventionally, there has been proposed a connector formed by a pair of connectors fitted to each other (see Japanese Laid-Open Patent Publication (Kokai) No. H11-233201 (Paragraphs [0018], [0022], and [0028], and FIG. 8).

One of the connectors is provided with a housing, a plurality of contacts, a plurality of shield plates, and a plurality of reinforcing end plates.

The housing has a frame portion in the form of a frame, and a protrusion extending in the longitudinal direction of the frame portion and located in the center of the frame portion. A receiving space for receiving the fitting portion of a mating connector is formed between the frame portion and the protrusion. The protrusion has a plurality of holding grooves formed at predetermined spaced intervals in the longitudinal direction thereof.

The contacts are received in the respective holding grooves, and held therein. Each contact has one end formed with a contact portion and the other end formed with a connection portion. The contact portion protrudes into the receiving space. The connection portion is soldered to an associated conductor trace of a circuit board.

The shield plates are mounted on opposite side surfaces of the housing, parallel to the longitudinal direction thereof, respectively.

The reinforcing end plates are mounted on longitudinal opposite end faces of the housing. The reinforcing end plates are generally U-shaped, and have electrically conductive and elastic properties. The opposite ends of the respective reinforcing end plates overlap the ends of the shield plates to press the shield plates against the housing. The outer periphery of the housing is surrounded by the shield plates and the reinforcing end plates.

The other connector is provided with a housing, a plurality of contacts, and a shield plate.

The housing of the other connector is substantially in the form of a frame. The foremost end of the housing in a fitting direction is inserted into the receiving space of the one connector.

The contacts has contact portions arranged on the inner peripheral surface of the housing, for being brought into contact with the contact portions of the contacts of the one connector, which protrude from the holding grooves of the housing of the one connector.

The shield plate covers the outer periphery of the housing.

When the foremost end of the housing of the other connector in the fitting direction is inserted into the receiving space of the housing of the one connector, the shield plate of the other connector is inserted into the receiving space of the one connector together with the housing of the other connector, whereby the shield plates of the one connector and the shield plate of the other connector are brought into contact with each other. As a result, the connectors are shielded by the shield plates thereof.

In the above-described prior art, the shield plates are mounted to the respective connectors, and when the connectors are fitted to each other, the shield plates of the one connector surround the shield plate of the other connector.

This increases the size of the one electric connector. To reduce the size of the one connector, it is only required to remove the shield plates from the one connector, but this makes it impossible to sufficiently shield the connectors.

SUMMARY OF THE INVENTION

The present invention has been made in view of these circumstances, and an object thereof is to provide a connector which is capable of sufficiently shielding two connectors for electrically connecting two circuit boards, and making the connectors compact in size.

To attain the above object, in a first aspect of the present invention, there is provided a connector comprising a housing that has a fitting portion for being fitted to a mating fitting portion of a mating connector, and is disposed on a circuit board, a plurality of contacts that are arranged in the fitting portion, and a shell that has a shell body disposed around the fitting portion and is mounted on the housing, the shell having a shell contact portion brought into contact with a mating ground contact of the mating connector, and a shell terminal portion fixed to a first ground trace of the circuit board.

With the arrangement of the connector according to the first aspect of the present invention, the connector includes a housing that has a fitting portion for being fitted to the mating fitting portion of the mating connector, and is disposed on a circuit board, a plurality of contacts that are arranged in the fitting portion, and a shell that has a shell body disposed around the fitting portion, and is mounted on the housing. The shell has a shell contact portion brought into contact with a mating ground contact of the mating connector, and a shell terminal portion fixed to a first ground trace of the circuit board. Therefore, when the connector and the mating connector are fitted to each other, the shell of the connector and the mating ground contact of the mating connector are brought into contact with each other, whereby the ground trace of the circuit board on which is mounted the connector and the ground trace of a circuit board on which is mounted the mating connector are connected to each other. Further, when the connectors are fitted to each other, the mating fitting portion of the mating connector is surrounded by the shell body of the shell of the connector.

Preferably, the plurality of contacts include at least one ground contact, and the shell has a fixedly engaging portion that is connected to the shell body, and causes the shell body to be fixedly engaged with the housing, and an auxiliary shell terminal portion adjacent to the one ground contact, the auxiliary shell terminal portion being connected to the shell body and fixed to a second ground trace.

To attain the above object, in a second aspect of the present invention, there is provided a mating connector comprising a mating housing that has a mating fitting portion for being fitted to a fitting portion of a connector, and is disposed on a mating circuit board, and a plurality of mating contacts that are arranged in the mating fitting portion, the plurality of mating contacts including a mating ground contact, the mating ground contact having a mating shell contact portion brought into contact with a shell mounted in a housing of the connector, and a mating terminal portion fixed to a ground trace of the mating circuit board.

With the arrangement of the mating connector according to the second aspect of the present invention, a plurality of mating contacts include a mating ground contact, and the mating ground contact has a mating shell contact portion brought into contact with a shell mounted in the housing of a connector, and a mating terminal portion fixed to a ground trace of a mating circuit board. Therefore, when the connector and the mating connector are fitted to each other, the mating ground contact of the mating connector and the shell of the connector are brought into contact with each other, whereby a ground trace of a circuit board on which is mounted the connector and the ground trace of the circuit board on which is mounted the mating connector are connected to each other. Further, when the connectors are fitted to each other, the mating fitting portion of the mating connector is surrounded by the shell body of the shell of the connector.

As described above, according to the present invention, it is possible to sufficiently shield two connectors for connecting two circuit boards and attain the reduction of the sizes of the connectors.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Referring to FIGS. 1 to 4, the connector device 100 is comprised of the receptacle connector (connector) 1 and a plug connector (mating connector) 12, The receptacle connector 1 is mounted on a first printed circuit board (circuit board) 21 (see FIG. 9) and the plug connector 12 is mounted on a second printed circuit board (mating circuit board), not shown.

Figure 5:
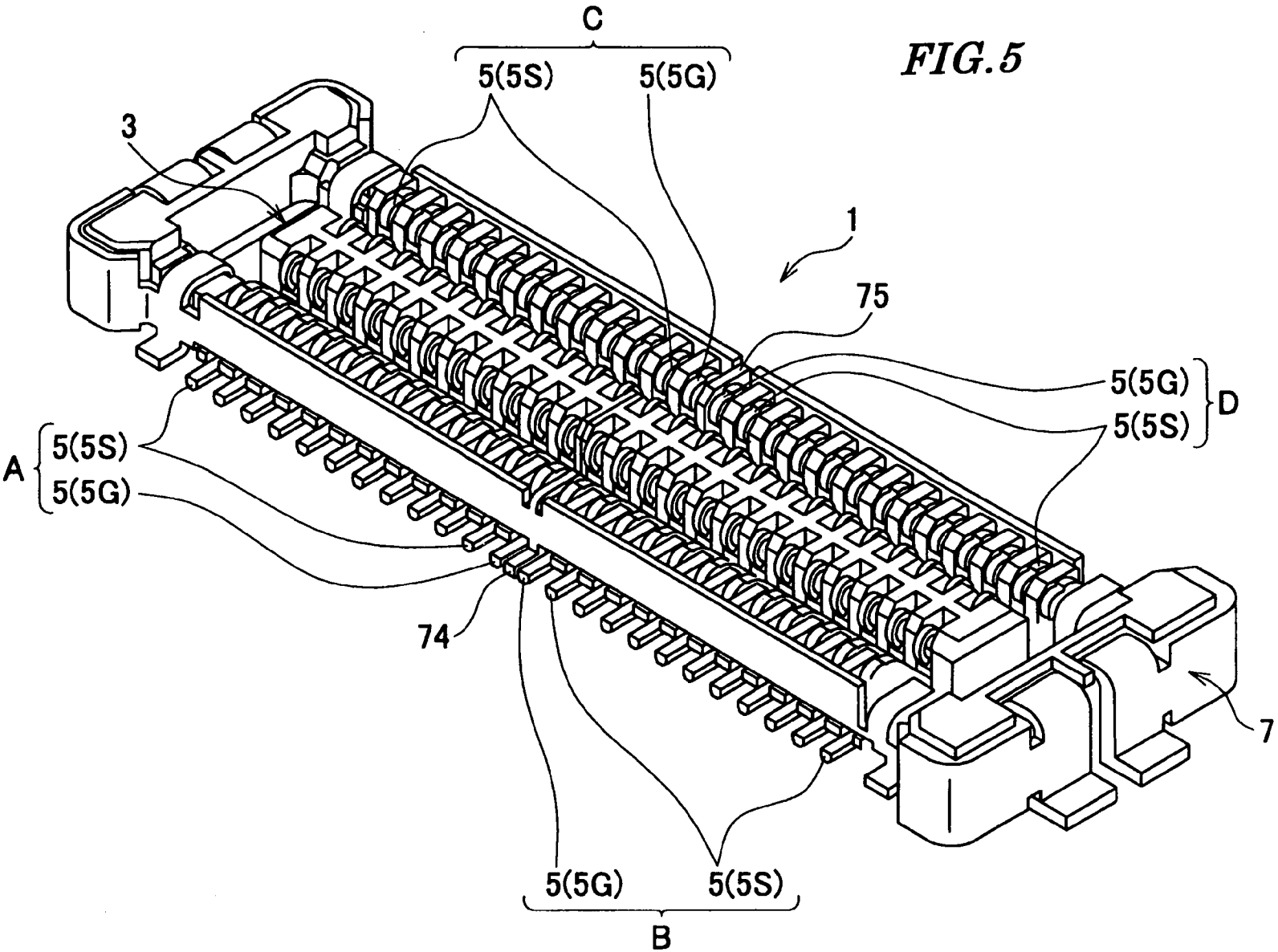
FIG. 5 is a perspective view of a receptacle connector of the FIG. 1 connector device.

As shown in FIG. 5, the receptacle connector 1 includes a receptacle-side housing (housing) 3, receptacle-side contacts (contacts) 5, and the shell 7.

Figure 6:
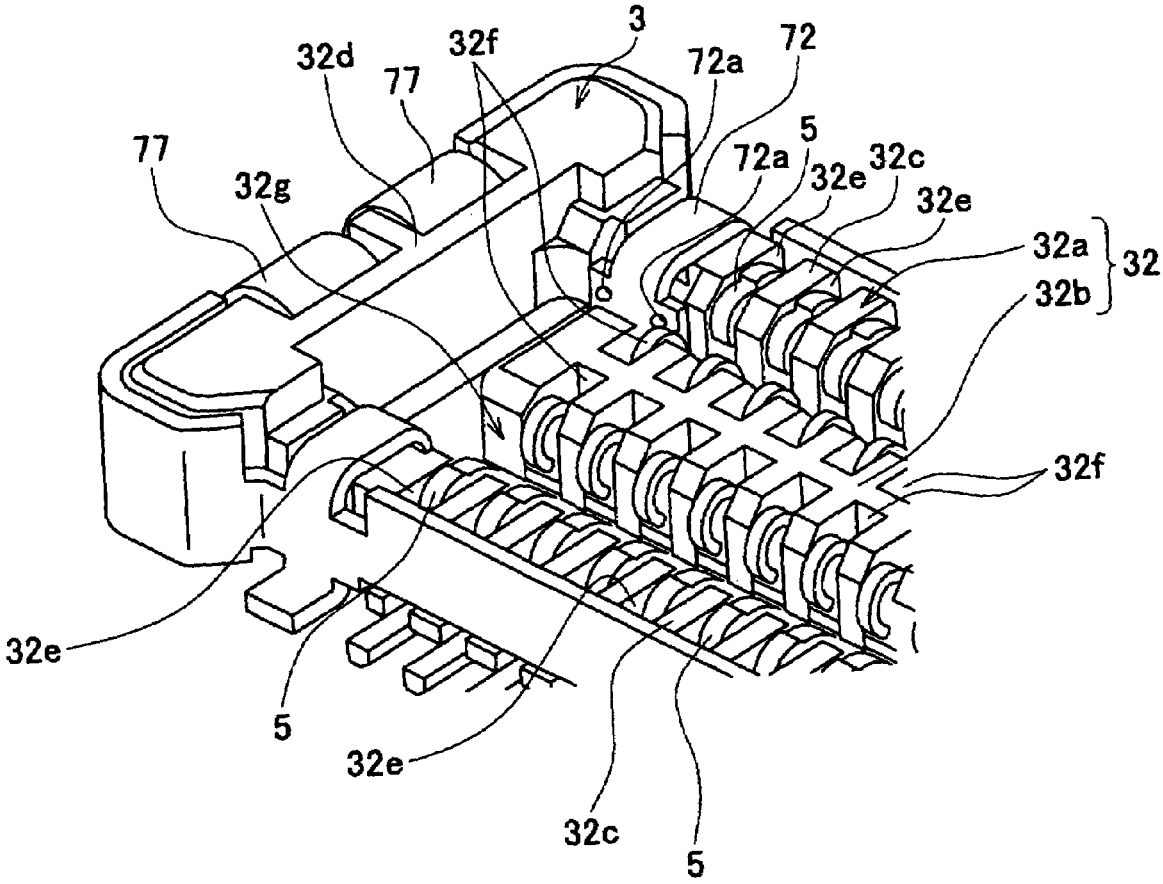
FIG. 6 is a perspective view of one end of the FIG. 5 receptacle connector.
Figure 7:
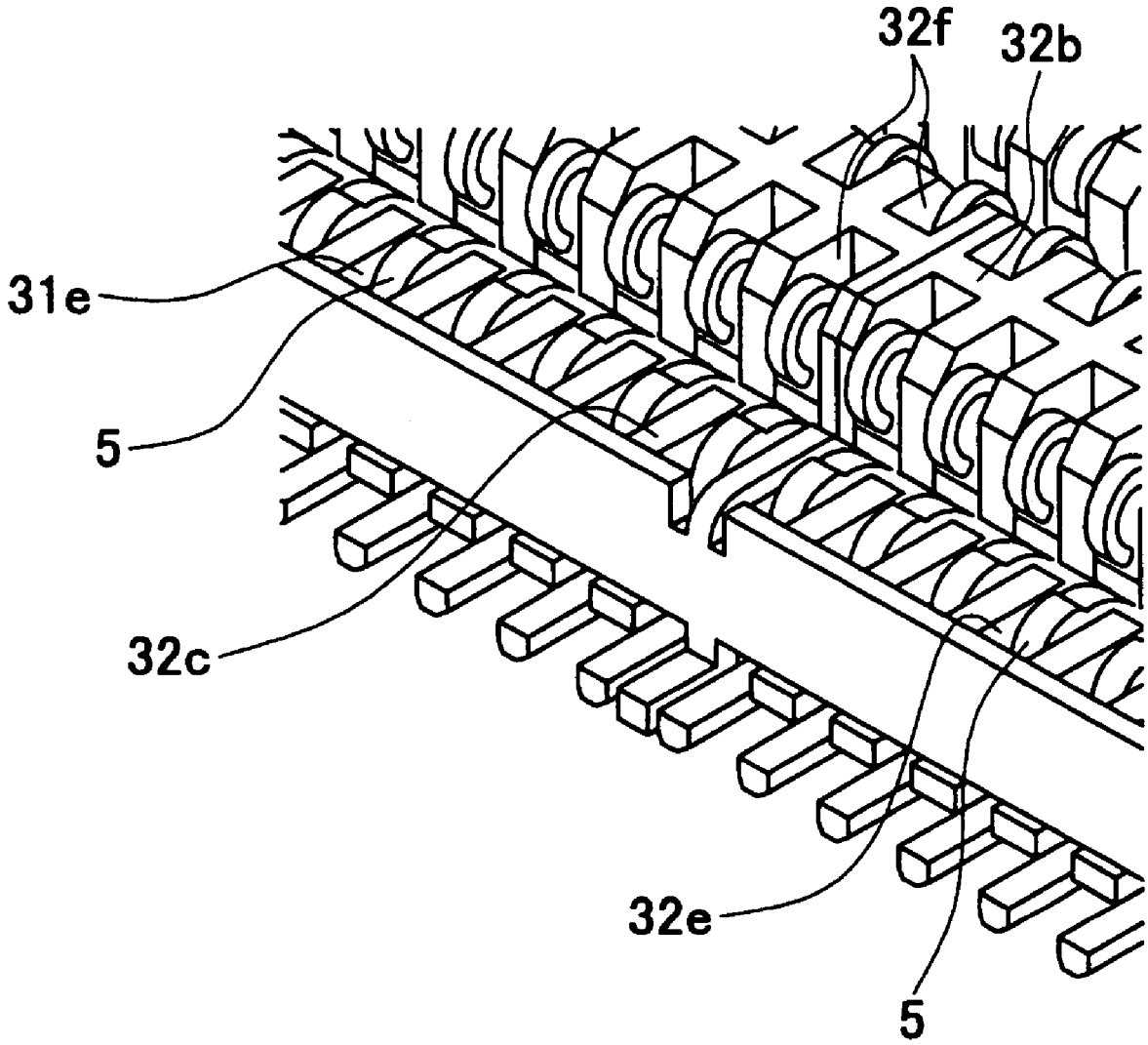
FIG. 7 is a perspective view of a central portion of the FIG. 5 receptacle connector.
Figure 8:
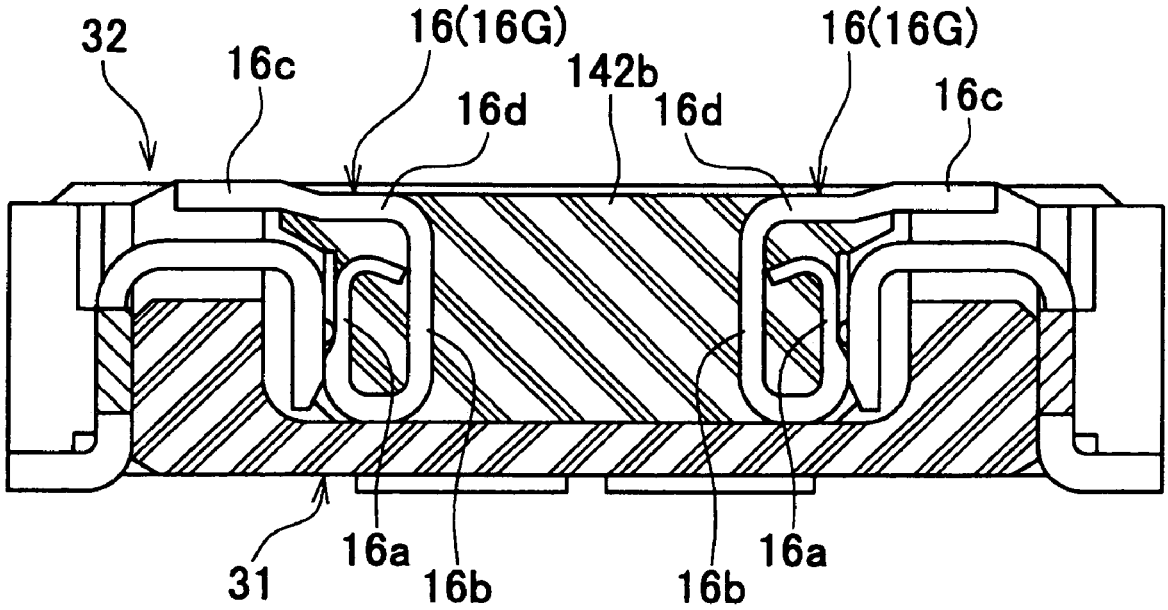
FIG. 8 is a cross-sectional view of one end of the FIG. 3 connector device.

As shown in FIGS. 6 to 8, the receptacle-side housing 3 includes a plate-like portion 31 and a receptacle-side fitting portion (fitting portion) 32.

The plate-like portion 31 is disposed on the first printed circuit board 21. The plate-like portion 31 is slightly lifted from the first printed circuit board 21.

The receptacle-side fitting portion 32 is formed on an upper surface of the plate-like portion 31. The receptacle-side fitting portion 32 is comprised of a frame-like portion 32*a* and a central protrusion 32*b*. The frame-like portion 32*a* has a pair of side wall portions 32*c* and 32*c* and a pair of ends 32*d* and 32*d*. The pair of side wall portions 32*c* and 32*c* are arranged in parallel with each other, and each side wall portion 32*c* is formed with a plurality of grooves 32*e* at predetermined spaced intervals. The pair of ends 32*d* and 32*d* are arranged in parallel with each other, and are connected to the ends of the pair of side wall portions 32*c* and 32*c*.

The central protrusion 32*b* is disposed in parallel with the pair of side wall portions 32*c* and 32*c*. The central protrusion 32*b* is formed with a plurality of grooves 32*f* at the same spaced intervals as those of the plurality of grooves 32*e*. The grooves 32*f* are opposed to the grooves 32*e*, respectively. The central protrusion 32*b* is surrounded by the frame-like portion 32*a*. A receiving space 32*g* is formed between the frame-like portion 32*a* and the central protrusion 32*b*. The receptacle-side fitting portion 32 receives a plug-side fitting portion 142 of a plug-side housing, described hereinafter.

Figure 9:
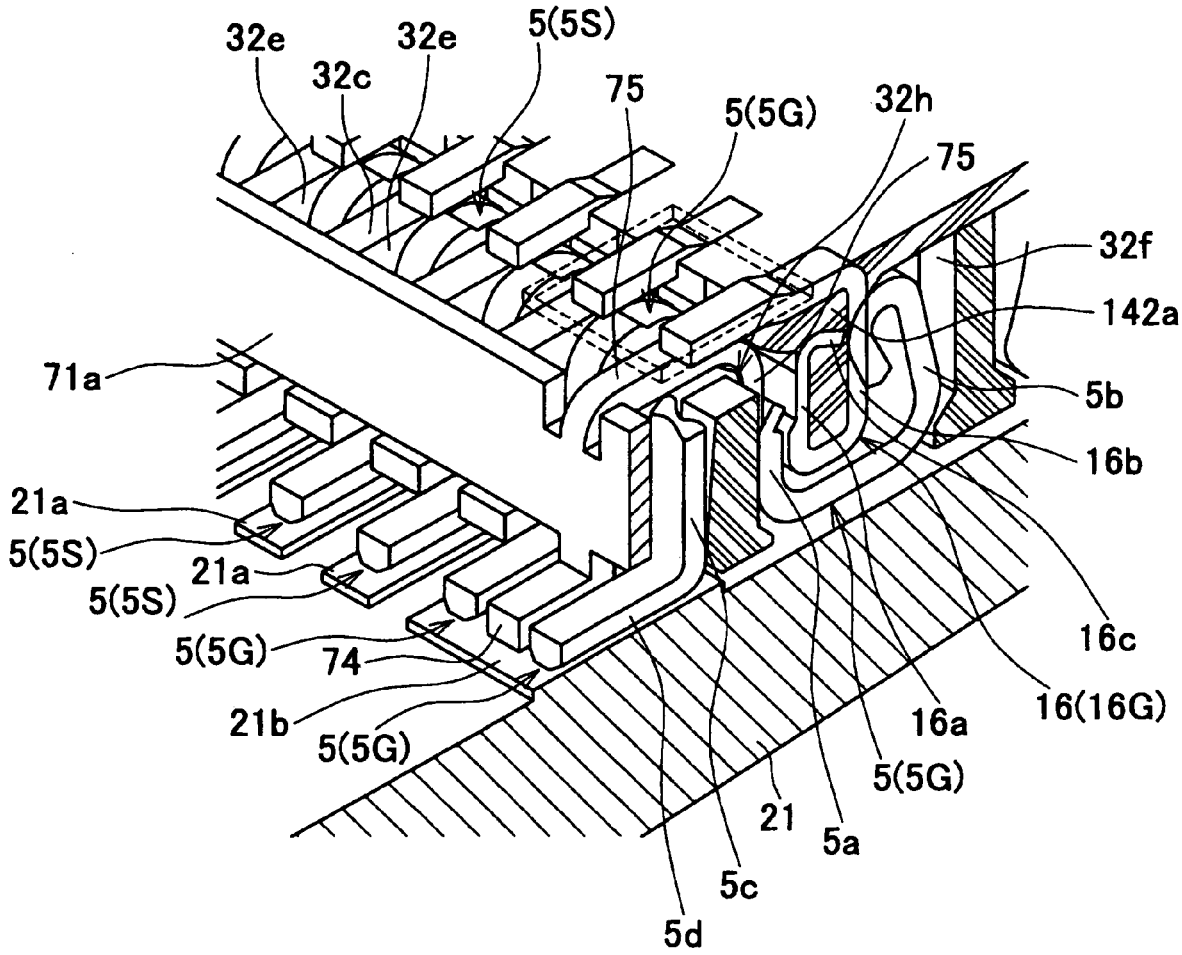
FIG. 9 is a perspective view of the FIG. 3 connector device, in a state cross-sectioned at a central portion thereof.
Figure 10:
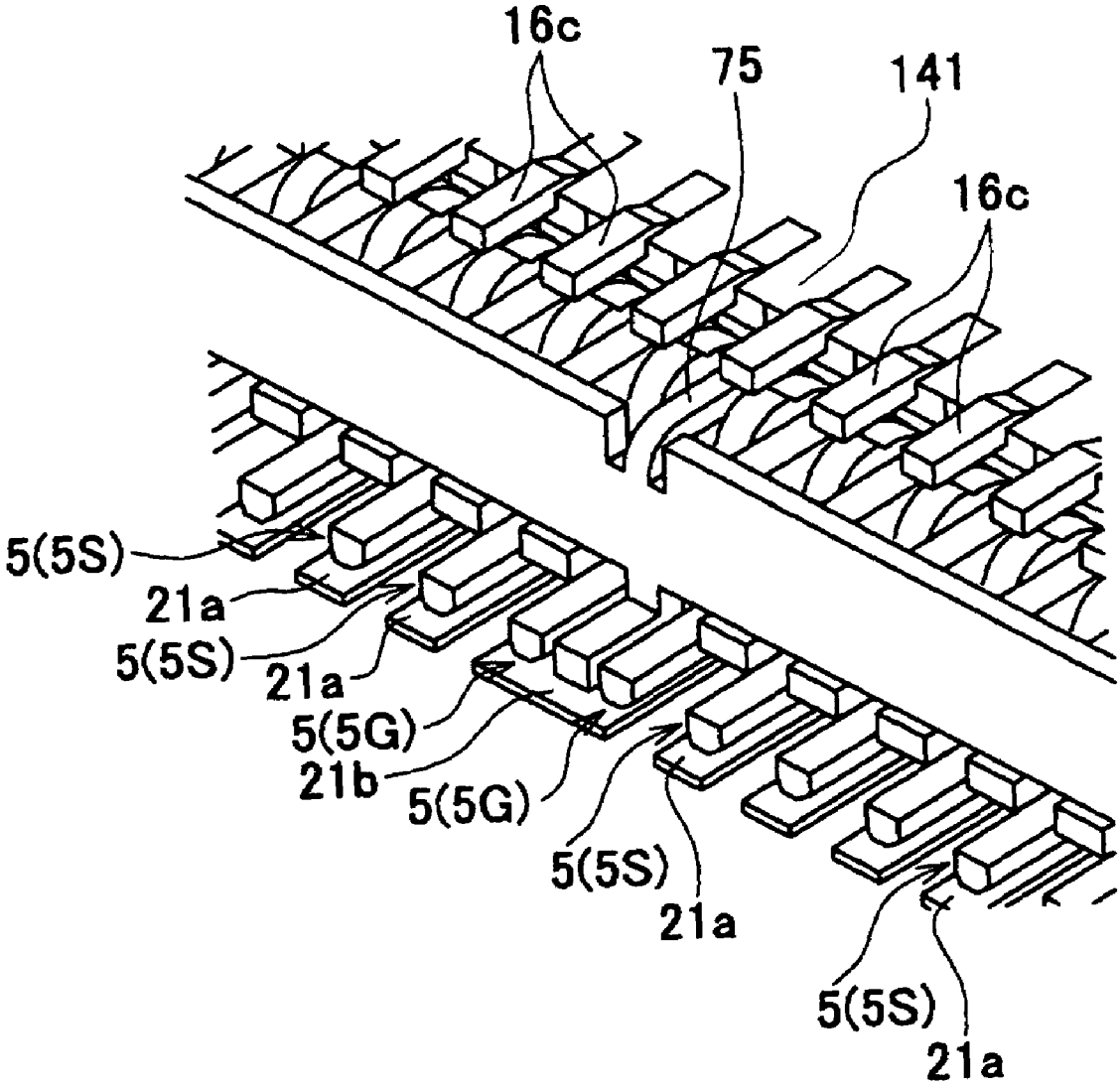
FIG. 10 is a perspective view of the central portion of the FIG. 3 connector device.

As shown in FIGS. 9 and 10, each receptacle-side contact 5 includes a first contact portion 5*a*, a second contact portion 5*b*, a held portion 5*c*, and a terminal portion 5*d*. The first contact portion 5*a* is formed at the intermediate portion of the receptacle-side contact 5. The second contact portion 5*b* is substantially e-shaped, and is connected to one end of the first contact portion 5*a*. The second contact portion 5*b* is elastically deformably received in each groove 32*f*. The held portion 5*c* is substantially inverted L-shaped, and is connected to the other end of the first contact portion 5*a*. The held portion 5*c* is received in each groove 32*e* to be held therein. The terminal portion 5*d* is substantially I-shaped, and is connected to the held portion 5*c*. The lower surface of the terminal portion 5*d* is located below the lower surface of the plate-like portion 31. The first contact portion 5*a* is in contact with a plug-side first contact portion 16*a*, and the second contact portion 5*b* is in contact with a plug-side second contact portion 16*b* and is connected to the same. Further, the first contact portion 5*a* is improved in a force in a direction of withdrawal of the connector, by a stepped portion 16*e* (see FIG. 14) of the plug-side first contact portion 16*a*, which increases a withdrawing force.

The receptacle-side contacts 5 include two kinds of contacts, i.e. receptacle-side signal contacts 5S and receptacle-side ground contacts (ground contacts) 5G. The shapes, sizes and materials of the contacts 5S and 5G are the same. The receptacle-side signal contact 5S is formed by soldering the terminal portion 5*d* to a signal pad 21*a* of the printed circuit board 21, while the receptacle-side ground contact 5G is formed by soldering the terminal portion 5*d* to a ground pad (second ground trace) 21*b* of the first printed circuit board 21. However, the arrangement of the signal contacts 5S and the receptacle-side ground contacts 5G on the receptacle-side housing 3 is determined in advance, and the signal pads 21*a* and the ground pad 21*b* of the first printed circuit board 21 are formed in a manner associated with the arranged contacts 5S and 5G.

Further, the plurality of the receptacle-side contacts 5 are grouped into four contact groups A, B, C, and D, with the central protrusion 32*b* and two second shell terminal portions 74 of the shell 7, described hereinafter, as boundaries (see FIG. 5).

Figure 11:
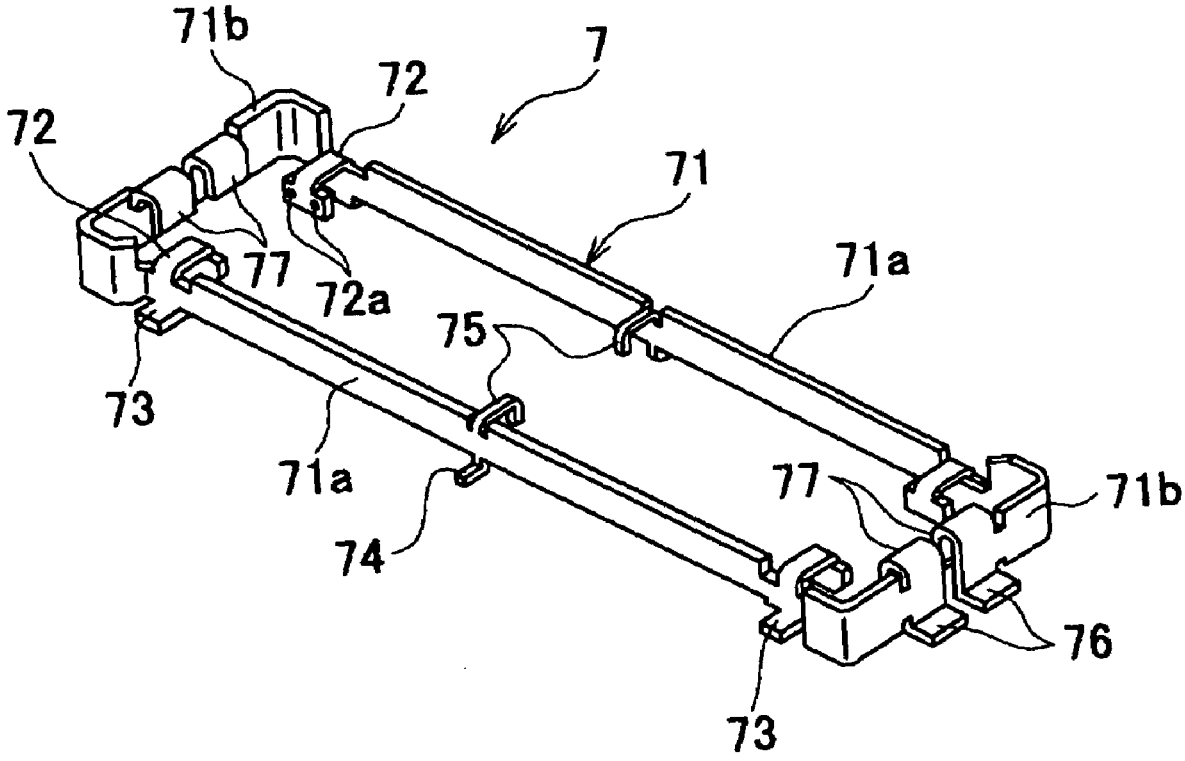
FIG. 11 is a perspective view of a shell of the FIG. 5 receptacle connector.

Referring to FIG. 11, the shell 7 is comprised of a shell body 71, shell contact portions 72, first shell terminal portions (shell terminal portions) 73, the second shell terminal portions (auxiliary shell terminal portions) 74, fixedly engaging portions 75, and hold-down and shell terminal portions 76.

The shell body 71 is substantially frame-like, and includes a pair of side plates 71*a* and 71*a*, and a pair of end plates 71*b* and 71*b*. The pair of side plates 71*a* and 71*a* are arranged in parallel with each other, and cover side surfaces of the side wall portions 32*c* and 32*c* of the receptacle-side fitting portion 32. The pair of end plates 71*b* and 71*b* are arranged in parallel with each other, and are connected to the ends of the pair of side plates 71*a* and 71*a*. The end plates 71*b* cover the respective outer surfaces of the ends 32*d* of the receptacle-side fitting portion 32.

The shell contact portions 72 are connected to the upper edges of the opposite ends of the side plates 71*a*. Each shell contact portion 72 protrudes inward from the side plate 71*a*. The shell contact portion 72 is bent into a substantially U-shape, and is generally T-shaped in developed plan view. The shell contact portion 72 has a foremost end formed with two contact points 72*a*. The distance between the two contact points 72*a* is equal to the distance between plug-side ground contacts 16G (see FIGS. 6 and 13). The two contact points 72*a* are brought into contact with two of the plug-side ground contacts 16G, described hereinafter, respectively.

The first shell terminal portions 73 are connected to the lower edges of the ends of the side plates 71*a*. Each first shell terminal portion 73 protrudes outward from the side plate 71*a*. The first shell terminal portion 73 is soldered to a ground pad (first ground trace), not shown, of the first printed circuit board 21. The first shell terminal portion 73 has a large width, and hence it is possible to enhance a soldering strength.

The second shell terminal portions 74 are connected to the lower edges of the central portions of the side plates 71*a*. Each second shell terminal portion 74 protrudes outward from the side plate 71*a*. The second shell terminal portion 74 is disposed between two receptacle-side ground contacts 5G, and is soldered to the ground pad 21*b* of the first printed circuit board 21. The second shell terminal portion 74 is located at the intermediate portion of each side plate 71*a*, so that the rigidity of the shell 7 is enhanced by the soldering of the second shell terminal portion 74 to the ground pad.

The fixedly engaging portions 75 are connected to the upper edges of the central portions of the side plates 71*a*. Each fixedly engaging portion 75 protrudes inward from the side plate 71*a*. The fixedly engaging portion 75 is bent into a substantially U-shape. The fixedly engaging portion 75 is disposed between the two receptacle-side ground contacts 5G (see FIG. 9). The fixedly engaging portion 75 is engaged with an engaging portion 32*h* (see FIG. 9) formed on an associated one of the side wall portions 32*c* of the receptacle-side housing 3. The side plates 71*a* are in contact with the respective side wall portions 32*c*.

The pair of end plates 71*b* each have the two hold-down and shell terminal portions 76 connected to a lower edge thereof. Each hold-down and shell terminal portion 76 protrudes outward from the end plate 71*b*. The hold-down and shell terminal portion 76 is soldered to the ground pad of the first printed circuit board 21. This causes the receptacle connector 1 to be positively shielded by the shell 7, and be rigidly fixed to the first printed circuit board 21.

The pair of end plates 71*b* each have an upper edge formed with two holding portions 77. Each holding portion 77 is bent into a substantially U-shape. The holding portion 77 is held by being press-fitted into an associated one of the ends 32*d* of the receptacle-side fitting portion 3 (see FIG. 6). It should be noted that the holding portions 77 may be held by being integrally formed with the receptacle-side housing 3 during insert molding of the housing 3.

Figure 12:
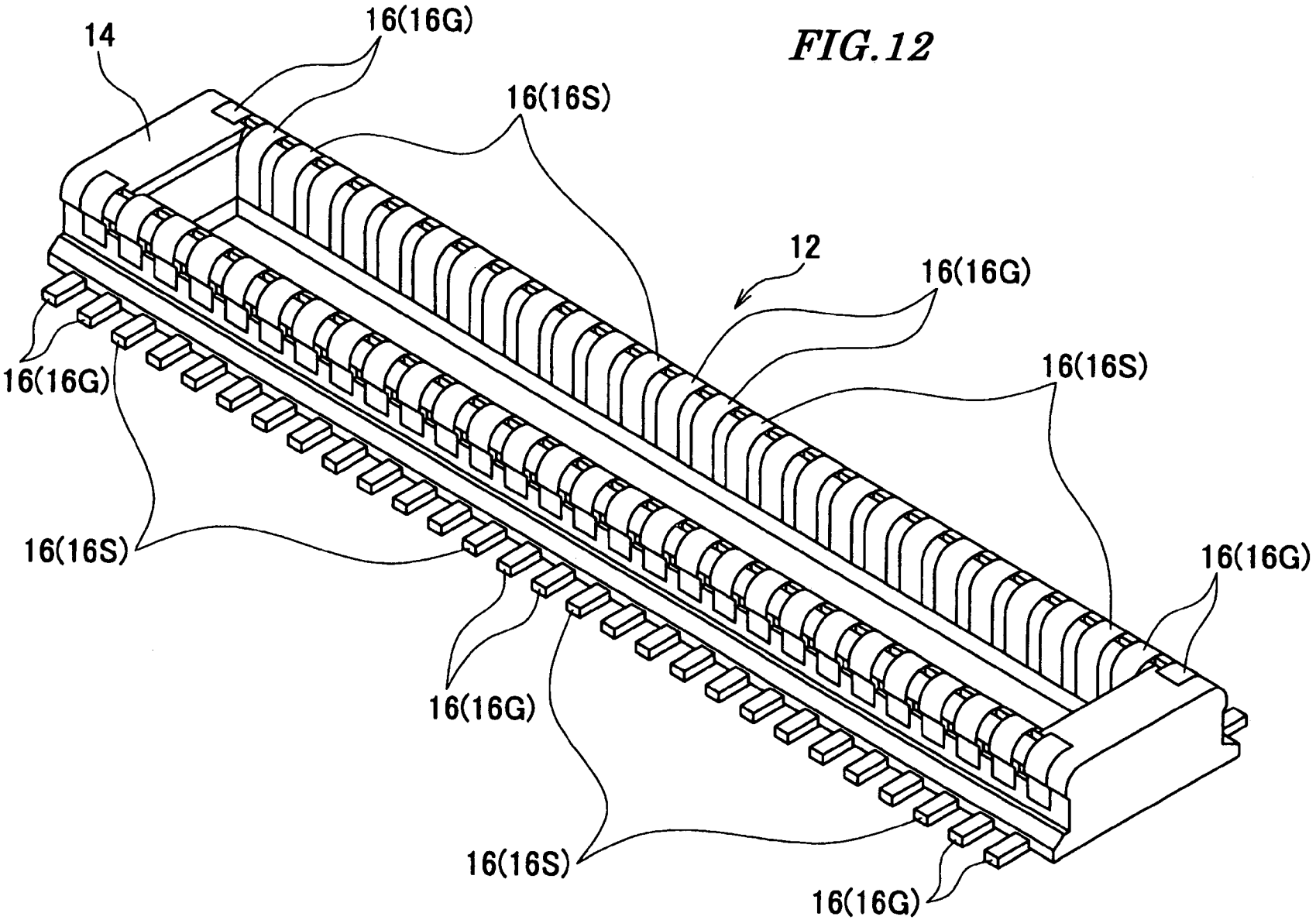
FIG. 12 is a perspective view of a plug connector of the connector device shown in FIG. 1, in a state presented in an inverted position.
Figure 13:
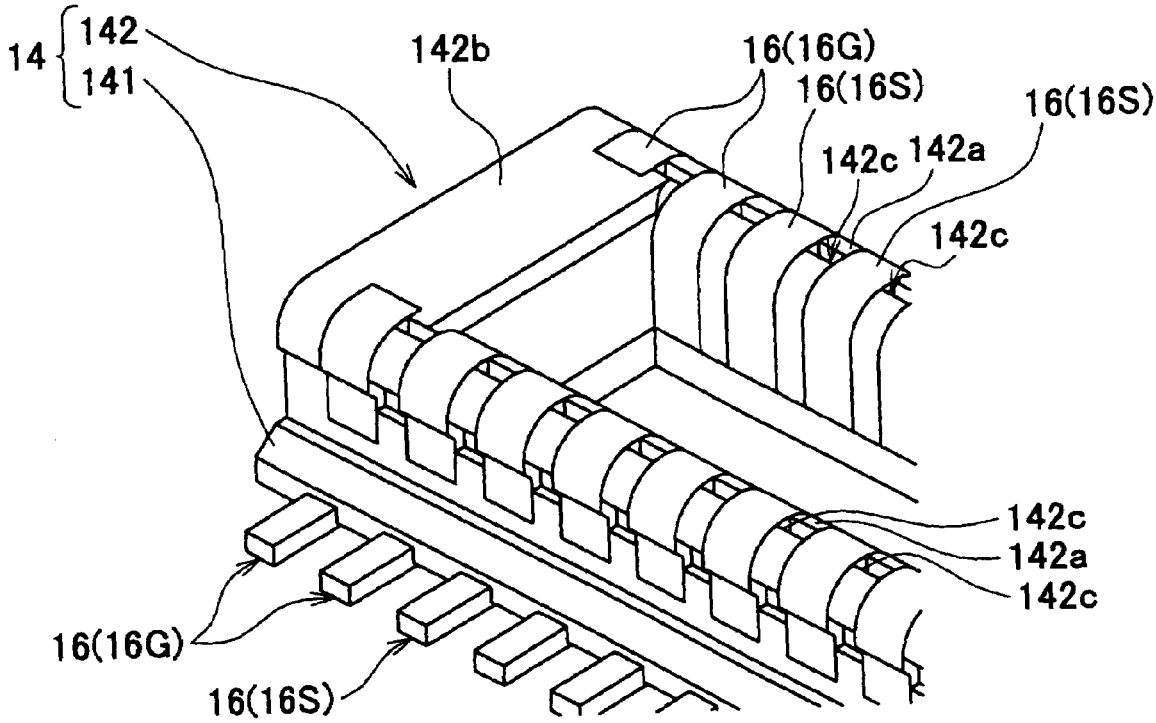
FIG. 13 is a perspective view of one end of the FIG. 12 plug connector.

As shown in FIGS. 12 and 13, the plug connector 12 is comprised of a plug-side housing (mating housing) 14 and a plurality of plug-side contacts (mating contacts) 16.

The plug-side housing 14 includes a plate-like portion 141 and a plug-side fitting portion (mating fitting portion) 142.

The plate-like portion 141 is disposed on a second printed circuit board, not shown. The plate-like portion 141 is slightly lifted from the second printed circuit board.

The plug-side fitting portion 142 is formed on a lower surface of the plate-like portion 141. The plug-side fitting portion 142 has a frame-like shape. The plug-side fitting portion 142 has a pair of side wall portions 142*a* and a pair of ends 142*b*. The pair of side wall portions 142*a* are arranged in parallel with each other, and each side wall portion 142*a* is formed with a plurality of grooves 142*c* at predetermined spaced intervals. The pair of ends 142*b* and 142*b* are arranged in parallel with each other, and are connected to the ends of the pair of side wall portions 142*a* and 142*a*.

Figure 14:
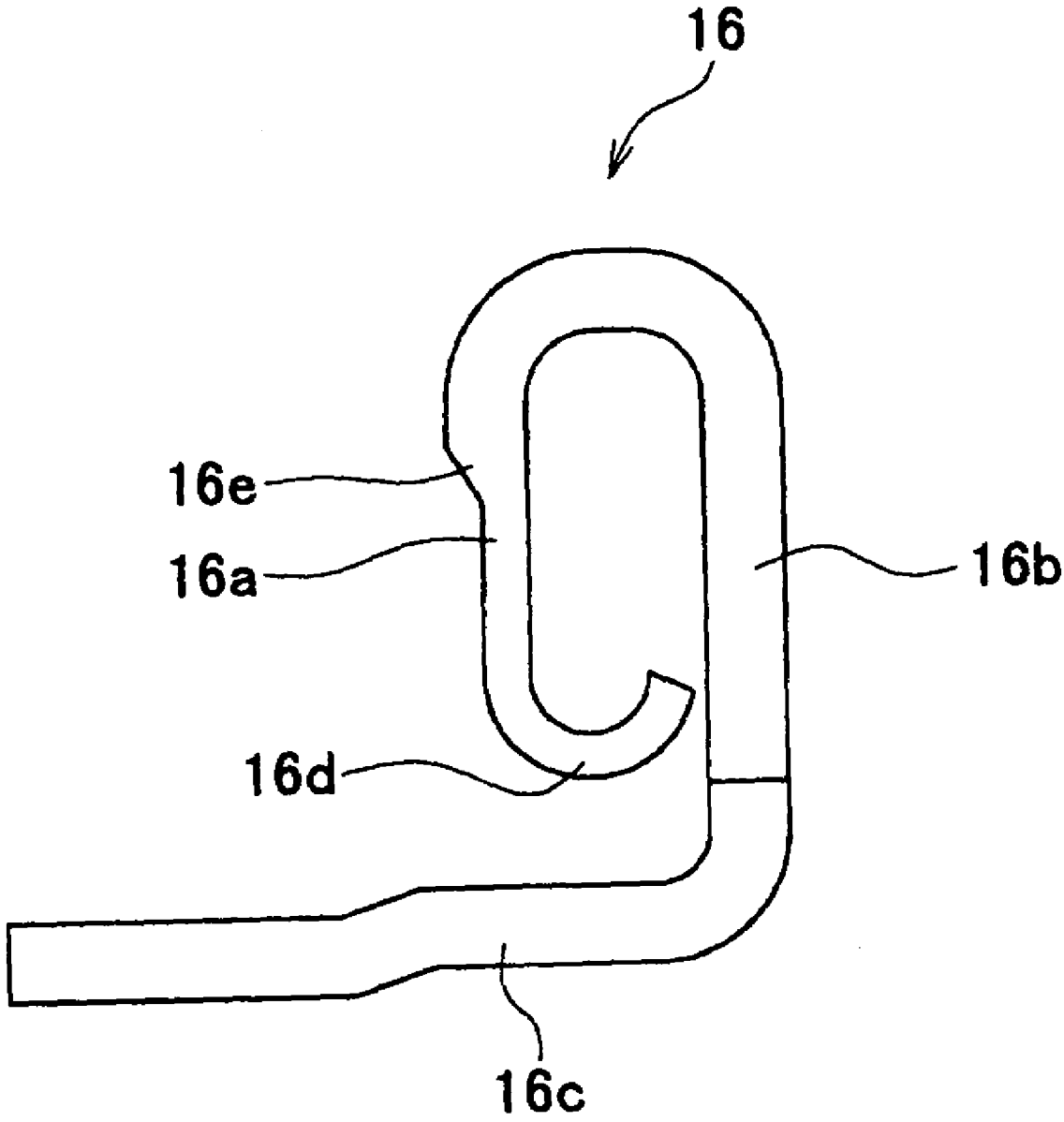
FIG. 14 is a side view of a plug-side contact of the FIG. 12 plug connector.
Figure 15:
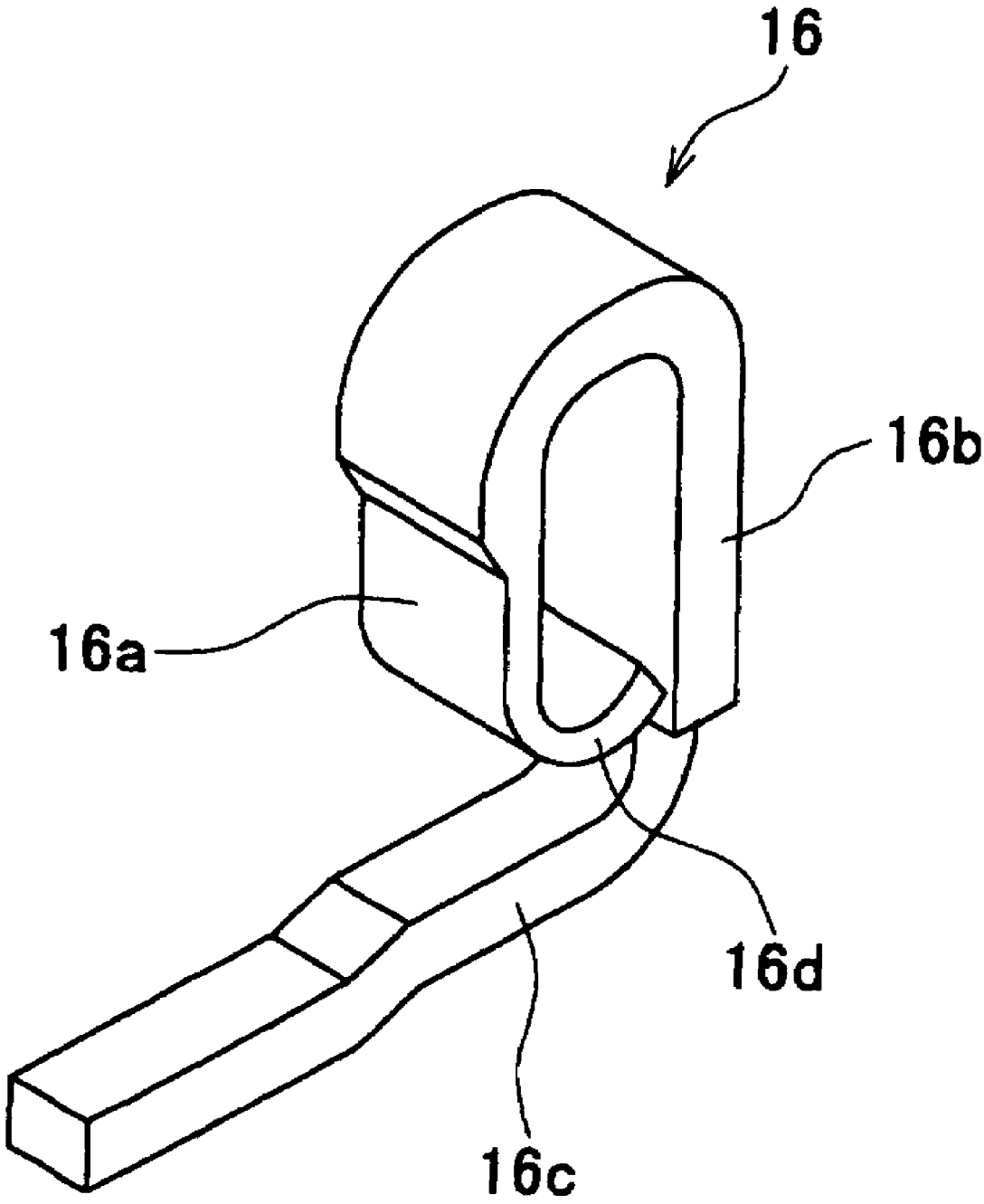
FIG. 15 is a perspective view of the FIG. 14 plug-side contact.

As shown in FIGS. 14 and 15, each plug-side contact 16 includes a first contact portion (mating shell contact portion) 16*a*, a second contact portion 16*b*, a terminal portion (mating terminal portion) 16*c*, and an embedded portion 16*d*. The first contact portion 16*a* is formed in the vicinity of the foremost end of the plug-side contact 16. The first contact portion 16*a* is in contact with an associated one of the first contact portions 5*a* of the receptacle-side contacts 5. The second contact portion 16*b* is connected to one end of the first contact portion 16*a*. The second contact portion 16*b* is in contact with an associated one of the second contact portions 5*b* of the receptacle-side contacts 5. The first contact portion 16*a* and the second contact portion 16*b* enclose an associated one of the side wall portions 142*a* (see FIG. 9). The terminal portion 16*c* is generally crank-shaped, and is connected to the second contact portion 16*b*. The upper surface of the terminal portion 16*c* is located above the upper surface of the plate-like portion 141 (see FIG. 10). The embedded portion 16*d* is connected to the other end of the first contact portion 16*a*. The embedded portion 16*d* is embedded during insert molding of the plug-side housing 14. Although in the present embodiment, the plug-side housing 14 and the plug-side contact 16 are integrally formed with each other, the foremost end of the first contact portion 16*a* may be press-fitted into the plug-side housing 14 to hold the plug-side contact 16, by removing the embedded portion 16*d*.

Although the plug-side contacts 16 include two kinds of contacts, i.e. plug-side signal contacts 16S and plug-side ground contacts (mating ground contacts) 16G, the shapes, sizes and materials of the contacts 16S and 16G are the same. The plug-side signal contact 16S is formed by soldering the terminal portion 16*c* to a signal pad of the second printed circuit board, while the plug-side ground contact 16G is formed by soldering the terminal portion 16*c* to a ground pad (ground trace) of the second printed circuit board. However, the arrangement of the plug-side signal contacts 16S and the plug-side ground contacts 16G on the plug-side housing 14 is determined in advance, and the signal pads and the ground pad of the second printed circuit board are formed in a manner associated with the arranged contacts 16S and 16G.

The plug-side signal contacts 16S each have the first contact portion 16 and the second contact portion 16*b* exposed, whereas as to the plug-side ground contacts 16G, only the four plug-side ground contacts 16G arranged on opposite ends of the plug connector 12 each have only the first contact portion 16*a* exposed, with the second contact portion 16*b* embedded in an end 142*b* of the plug-side housing 14 together with the embedded portion 16*d*.

Figure 1:
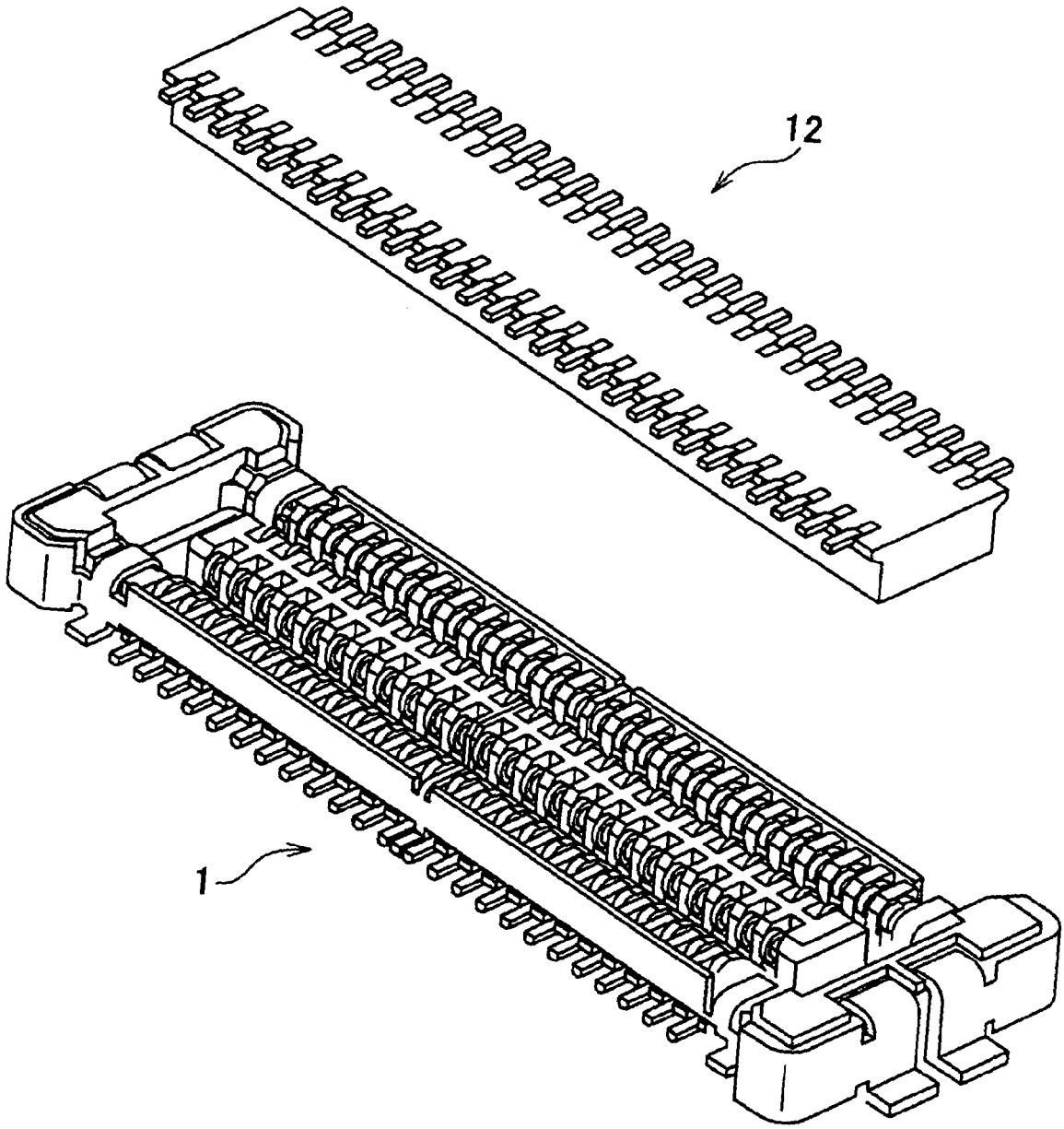
FIG. 1 is a perspective view of a connector device according to an embodiment of the present invention, in a non-fitted state.
Figure 2:
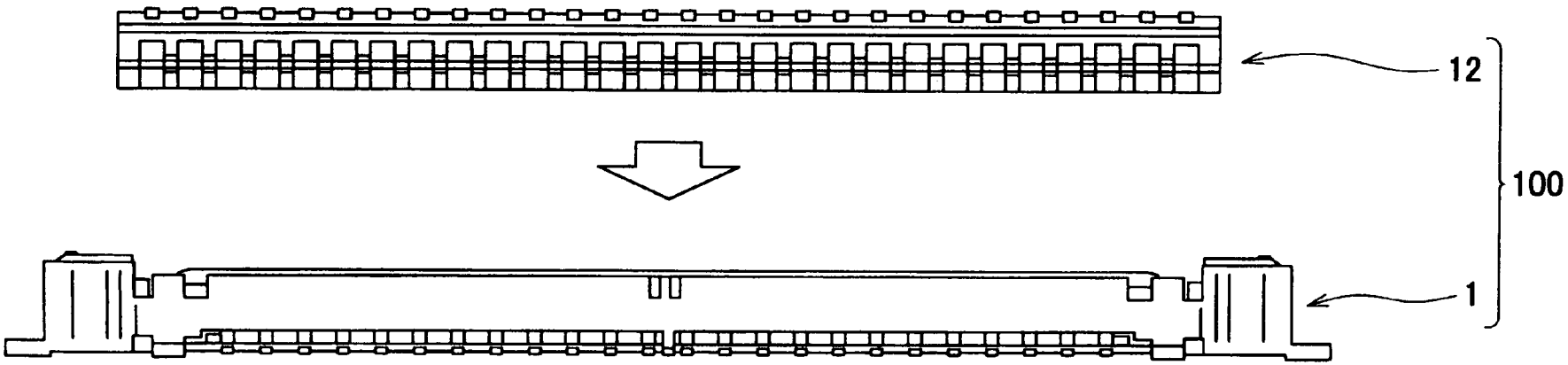
FIG. 2 is a side view of the FIG. 1 connector device in the non-fitted state.
Figure 3:
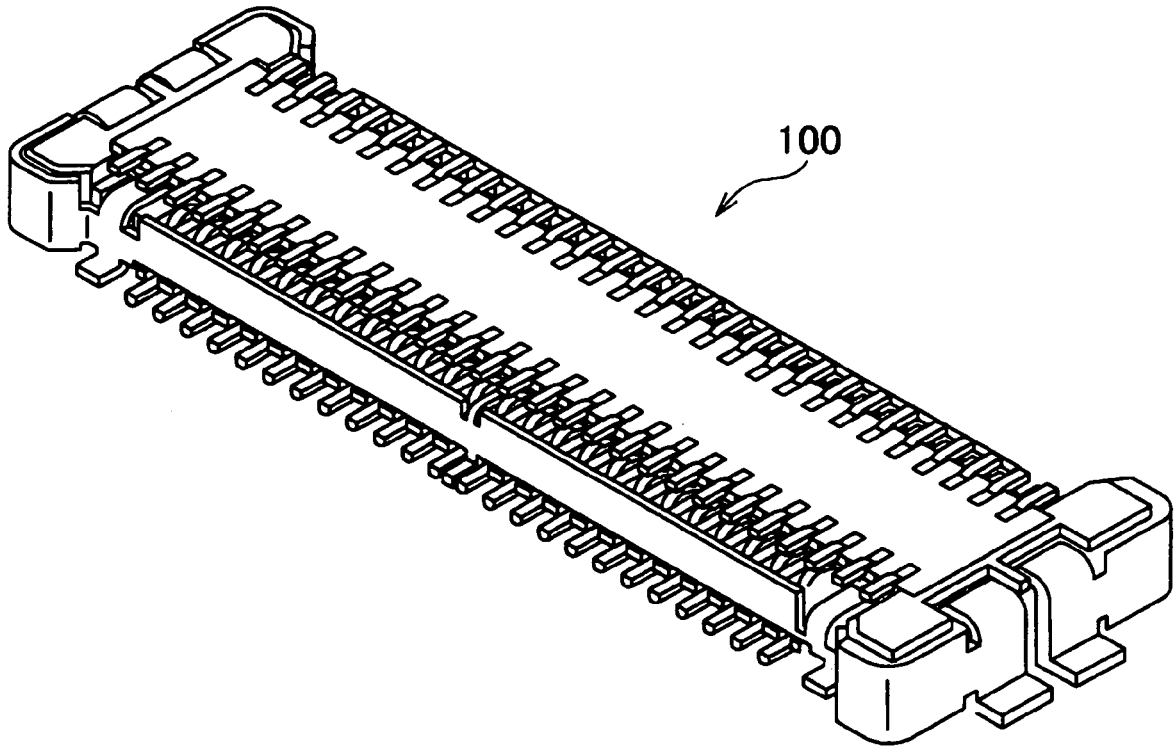
FIG. 3 is a perspective view of the FIG. 1 connector device in a fitted state.
Figure 4:
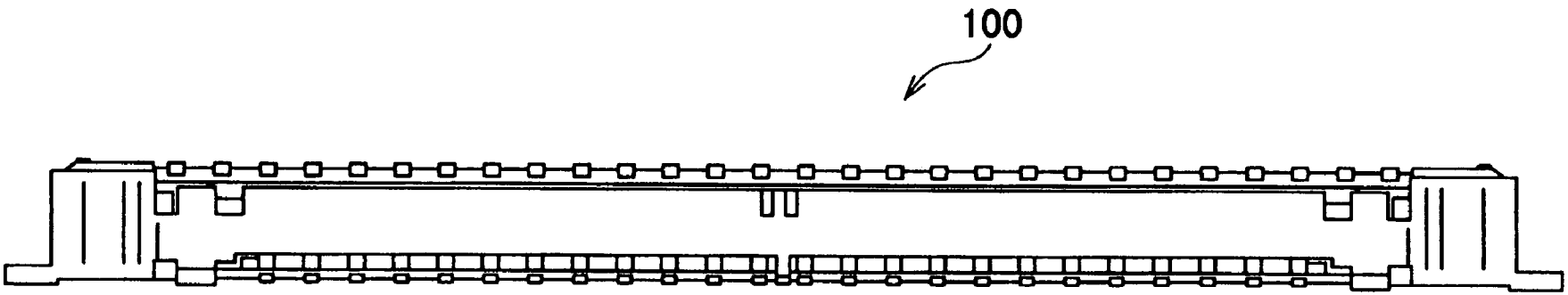
FIG. 4 is a side view of the FIG. 1 connector device in the fitted state.

The plug connector 12 is disposed above the receptacle connector 1 (see FIGS. 1 and 2), and from this state, when the plug connector 12 is lowered, as indicated by an arrow in FIG. 2, to push the plug-side fitting portion 142 of the plug connector 12 into the receptacle-side fitting portion 32 of the receptacle connector 1, the receptacle connector 1 and the plug connector 12 are fitted to each other (see FIGS. 3 and 4). As a result, the first and second printed circuit boards are electrically connected to each other via the connectors 1 and 12.

At this time, the plug-side fitting portion 142 of the plug connector 12 is received in the receptacle-side fitting portion 32 of the receptacle connector 1, and the plug-side ground contacts 16G of the plug connector 12 are brought into contact with the shell contact portions 72 of the shell 7 of the receptacle connector 1, so that the ground pad of the first printed circuit board 21 on which is mounted the receptacle connector 1, and the ground pad of the second printed circuit board on which is mounted the plug connector 12 are connected to each other. Further, when the connectors 1 and 12 are fitted to each other, the plug-side fitting portion 142 of the plug connector 12 is surrounded by the shell body 71 of the shell 7 of the receptacle connector 1. This makes it possible to obtain more stable grounding effects.

According to the present embodiment, since the shell can be removed from the plug connector 12, it is possible to reduce the size of the plug connector 12.

Further, since the receptacle connector 1 includes the hold-down and shell terminal portions 76, it is possible to mount the receptacle connector 1 on the first printed circuit board 21 more positively and shield the connectors 1 and 12 more positively.

Further, the second shell terminal portion 74 is located at the intermediate portion of the receptacle connector 1, and located between the two adjacent contact groups, which makes it possible to realize further enhancement of the ground. It should be noted that although one second shell terminal portion 74 and one fixedly engaging portion 75 are arranged on one and the other of each pair of side plates 71*a*, respectively, a plurality of second shell terminal portions 74 and a plurality of fixedly engaging portions 75 may be arranged on one and the other of each pair of side plates 71*a*.

It should be noted that although in the present embodiment, the shell 7 has the second shell terminal portions 74, the fixedly engaging portions 75, the hold-down and shell terminal portions 76, and the holding portions 77, it is possible to omit them.

Further, although the four shell contact portions 72 and the four shell terminal portions 73 are provided in the shell 7, the number of the shell contact portions 72 and that of shell terminal portions 73 are not particularly limited.

It is further understood by those skilled in the art that the foregoing are the preferred embodiments of the present invention, and that various changes and modification may be made thereto without departing from the spirit and scope thereof.

What is claimed is:

1. A connector comprising:

a housing that has a fitting portion for being fitted to a mating fitting portion of a mating connector, said housing being disposed on a circuit board;

a plurality of contacts that are arranged in said fitting portion; and a shell that has a shell body disposed around said fitting portion, said shell being mounted on said housing, and said shell comprising a shell contact portion brought into contact with a mating ground contact of said mating connector, and a shell terminal portion fixed to a first ground trace of said circuit board;

wherein said plurality of contacts include at least one ground contact;

wherein said shell further comprises: (i) a fixed engaging portion that is connected to said shell body and that fixedly engages said shell body with said housing, and (ii) an auxiliary shell terminal portion adjacent to said one ground contact; and wherein said auxiliary shell terminal portion is connected to said shell body and fixed to a second ground trace of said circuit board, and said ground contact is fixed to said second ground trace of said circuit board.

2. A connector device comprising:

a connector; and a mating connector;

wherein said connector comprises:

a housing that has a fitting portion for being fitted to a mating fitting portion of said mating connector, said housing being disposed on a circuit board;

a plurality of contacts that are arranged in said fitting portion; and a shell that has a shell body disposed around said fitting portion, said shell being mounted on said housing, and said shell comprising a shell contact portion brought into contact with a mating ground contact of said mating connector, and a shell terminal portion fixed to a first ground trace of said circuit board;

wherein said plurality of contacts include at least one ground contact;

wherein said shell further comprises: (i) a fixed engaging portion that is connected to said shell body and that fixedly engages said shell body with said housing, and (ii) an auxiliary shell terminal portion adjacent to said one ground contact; and wherein said auxiliary shell terminal portion is connected to said shell body and fixed to a second ground trace of said circuit board, and said ground contact is fixed to said second ground trace of said circuit board; and wherein said mating connector comprises:

a mating housing that has said mating fitting portion for being fitted to said fitting portion of said connector, said mating housing being disposed on a mating circuit board; and a plurality of mating contacts that are arranged in said mating fitting portion, wherein said plurality of mating contacts include said mating ground contact, and said mating ground contact comprises a mating shell contact portion to be brought into contact with said shell mounted on said housing of said connector, and a mating terminal portion that is fixed to a ground trace of said mating circuit board.

* * * * *